US005800154A

United States Patent [19]

Henninger et al.

[11] Patent Number: 5,800,154

[45] Date of Patent: Sep. 1, 1998

[54] GAS HEATED APPLIANCE FOR PERSONAL USE

[75] Inventors: Friedrich Henninger, Kelkheim; Dieter Liebenthal, Maintal-Dörnigheim; Michael Stolper, Eschborn, all of Germany; Anne Tregoning Miller, Cambridge, Great Britain

[73] Assignee: Braun Aktiengesellschaft, Frankfurt, Germany

[21] Appl. No.: 759,362

[22] Filed: Nov. 1, 1996

Related U.S. Application Data

[63] Continuation of PCT/DE96/00434, Mar. 6, 1996.

[30] Foreign Application Priority Data

Apr. 8, 1995 [DE] Germany ..... 195 13 409.5
Dec. 16, 1995 [EP] European Pat. Off. . PCT/EP 95/04990

[51] Int. Cl.[6] ..... F23N 5/00

[52] U.S. Cl. ..... 431/75; 251/11; 126/403; 126/406; 126/401; 431/83

[58] Field of Search ..... 126/401, 403, 126/404, 406, 407, 408, 409, 412, 414; 431/75, 83; 251/11; 236/101 R

[56] References Cited

U.S. PATENT DOCUMENTS

| | | | |
|---|---|---|---|
| 1,984,444 | 12/1934 | Thornhill | 431/83 |
| 4,243,017 | 1/1981 | Diedrich | 126/409 |
| 4,248,208 | 2/1981 | Diedrich | 126/409 |
| 4,327,752 | 5/1982 | Hickel | 132/37 |
| 4,354,482 | 10/1982 | Beisecker | 126/409 |
| 4,361,133 | 11/1982 | Bonnema | 126/408 |
| 4,382,448 | 5/1983 | Tittert | 132/33 |
| 4,699,123 | 10/1987 | Zaborowski | 126/409 |
| 4,733,651 | 3/1988 | Schawbel et al. | 126/409 |
| 4,881,520 | 11/1989 | Hefling | 431/344 |

FOREIGN PATENT DOCUMENTS

| | | | |
|---|---|---|---|
| 002 173 A1 | 6/1979 | European Pat. Off. | F16K 7/12 |
| 021 224 A1 | 1/1981 | European Pat. Off. | A45D 2/36 |
| 021 224 B1 | 1/1981 | European Pat. Off. | A45D 2/36 |
| 23 46 435 | 5/1978 | Germany | A45D 2/36 |
| 36 17 218 A1 | 11/1987 | Germany | A45D 2/36 |
| 87 06 838 U | 11/1987 | Germany | A45D 2/36 |
| 2191269 | 12/1987 | United Kingdom | F16K 1/36 |

*Primary Examiner*—Carroll B. Dority
*Attorney, Agent, or Firm*—Edward S. Podszus

[57] ABSTRACT

The invention is directed to a gas-heatable appliance for personal use as, for example, a curling iron, a curling brush, a hair dryer, an epilating appliance, a domestic appliance, or the like, including a fuel gas reservoir, a combustion chamber, and a valve assembly disposed between the fuel gas reservoir and the combustion chamber for controlling and/or regulating the amount of fuel gas supplied, in particular in dependence upon temperature. There are further provided a valve housing (4) with a gas passageway (5, 15, 16) and a sealing element (6) associated with the gas passageway (5, 15, 16), as well as an actuator (7) for actuating the sealing element (6). The element is configured as a control member actuatable by a user and/or as a temperature-responsive actuator (7). In this arrangement, the sealing element (6) is actuated directly by the actuator (7).

46 Claims, 8 Drawing Sheets

10
5
20
15
6
14
13
20
12
16
19
17
11
18
20
4
21
7
8
9

GAS HEATED APPLIANCE FOR PERSONAL USE

This is a continuation of International Application No. PCT/DE96/00434, pending, with an international filing date of Mar. 6, 1996.

This invention relates to a gas-heatable appliance for personal use as, for example, a curling iron, a curling brush, a hair dryer, an epilating appliance, a domestic appliance, or the like, including a fuel gas reservoir, a combustion chamber, and a valve assembly disposed between the fuel gas reservoir and the combustion chamber for controlling and/or regulating the amount of fuel gas supplied, in particular in dependence upon temperature, there being provided a valve housing with a gas passageway and a sealing element associated with the gas passageway, as well as an actuator for actuating the sealing element. In this arrangement, the actuator is configured as a control member actuatable by a user and/or as a temperature-responsive actuator.

Gas-heatable appliances for personal use are well known in the art. A valve assembly is already disclosed in European Pat. No. 0 021 224, (see U.S. Pat. No. 4,243,017 and U.S. Pat. No. 4,248,208). This patent describes a hair treating appliance with a catalytic heating device provided in the area of the hair winding portion, with a fuel reservoir for receiving preferably liquid fuel, with a device for vaporizing the fuel, a device for mixing the fuel gas with fresh air, and a catalytic device disposed in the combustion chamber. In this arrangement, a valve assembly is provided having an actuating member for controlling the fuel-gas/air mixture impinging upon the catalytic device in dependence upon the temperature prevailing in the combustion chamber, as well as an ignition device formed integral with the hair treating appliance and having a control member for initiating combustion.

It is a disadvantage of these known appliances that they are comprised of a plurality of individual components and include a valve device equally made up of a multiplicity of different components. Further, the sealing means associated with the gas passageway and provided in the valve housing are conventionally of such geometrical shape and material as to be subject to normal wear. In consequence, a sealing means ceases to effect a tight seal against the gas passageway following use for a period of some time, which may influence the temperature control function.

It is an object of the present invention to simplify the appliance to the effect that a lower number of components are required and that the appliance, in particular the valve, can be used safely as provided for the full service life of the appliance, in order to thus reduce manufacturing cost.

According to the present invention, this object is accomplished in a gas-heatable appliance for personal use of the type initially referred to in that the sealing element is actuatable directly by an actuator. The advantage thereby obtained is that direct actuation of an actuator on the sealing element results in a significant reduction in the number of components. Transmission members such as levers or the like which transmit the temperature-responsive control of the actuator to the sealing element are thus avoided; the use of fewer parts and the simplified assembly reduce the manufacturing cost, in addition to increasing the safety of the appliance when in use.

In a greatly advantageous feature of the sealing element, it is formed, in particular cut out, from a metal film in particular as an elastic, diaphragm-type element. This results in an extremely simple manufacture of the sealing elements, in addition to enabling the sealing element to be actuated in an absolutely wear-free manner.

In a further feature of the present invention, a film-type partition wall having an orifice for the passage of gas is arranged in the gas passageway. The gas orifice may be provided at any desired location in the partition wall, and the diameter of the orifice may be selected freely. In this arrangement, the partition wall may be fabricated from the same film material as the sealing element.

In a particularly advantageous embodiment of the present invention, the gas orifice is closable by an elastic, tongue-shaped element. This thus enables a film-type sealing element and the partition wall to be arranged in the valve housing in relative abutting engagement, with the partition wall providing the defined orifice, while opening and closing of this gas orifice is effected by the second elastic, tongue-shaped film.

In a particular embodiment, the tongue-shaped sealing element has one end thereof hinged to the partition wall in which the orifice for the passage of gas is provided. This holds both parts in a mounting position, and the tongue-shaped sealing element is in a position to pivot about its hinge in the manner of a lever.

In an advantageous embodiment, the tongue-shaped sealing element is arranged such as to automatically close the gas orifice when in the no-load position in which the actuator does not act upon the sealing element. The advantageous effect thereby achieved is that the tongue-shaped sealing element, rather than being moved by outside action, is moved solely by the restoring force of the elastic material of the sealing element as well as by reason of the arrangement of the tongue-shaped sealing element relative to the partition wall in which the orifice is provided.

In an alternative embodiment, it is proposed providing an additional element for boosting the closing force of the sealing element as it closes the gas orifice. This means may be a compression spring, for example, which is provided on the upstream side of the sealing element, urging the sealing element directly against the partition wall. This has the advantageous effect of ensuring closing of the gas orifice by the sealing means reliably at all times.

In another advantageous embodiment of the present invention, an actuator is provided as, for example, a bimetal rod known in the art which is guided through the gas orifice towards the tongue-shaped sealing means. As a result, the sealing element is directly actuated by the actuator without the use of additional mechanisms, such as levers or the like.

In a particular embodiment, the actuator is arranged on the downstream side, and the tongue-shaped sealing element is arranged on the upstream side of the gas orifice, gas flow being from the fuel gas reservoir through the valve assembly to the combustion chamber. As a result, closing of the tongue-shaped sealing means is effected automatically by the higher gas pressure prevailing on the upstream side of the partition wall with its gas orifice, unless this higher pressure is counteracted by the actuator.

In a particularly advantageous embodiment of the present invention, sealing element made of metal exclusively is provided in the gas passageway between the fuel gas reservoir and the combustion chamber, thus precluding any wear, in particular by attrition, of a non-metal sealing element.

In an alternative embodiment, an additional sealing surface is provided between the metal sealing element and the metal partition wall. This sealing surface may be fabricated, for example, from an elastic material, in particular plastics or the like, and it may be provided as a separate sealing member or as a coating applied to the sealing element or to the partition wall. In this arrangement, the gas orifice remains an opening.

Advantageously, the valve housing receiving the gas passageway and the sealing element is comprised of at least two housing halves. This affords ease of manufacture of the valve housing as well as ease of assembly of the valve device.

Advantageously, the sealing element is provided at the location of the parting line between the two housing halves, so that in a conventional, plane configuration of the parting line the sealing element can be simply sandwiched and secured between the two housing halves.

Advantageously, the gas passageway is provided at the parting line of the two housing halves, so that the passageway extends on either side of the sealing element, causing the sealing element, in particular the metal film, to divide the gas passageway into an upstream and a downstream section.

In an advantageous feature of the present invention, the stream of gas carried in the gas passageway is deflectable by the sealing element. This enables the gas stream to be directed at selected regions on either side of the sealing element, in addition to allowing a position-independent arrangement of the fuel gas reservoir and of the combustion chamber on different sides of the valve, because the gas inlet and the gas outlet channel of the valve may be arranged at different locations.

Another embodiment of the present invention proposes having the user actuate the control member to effect opening and closing of the gas passageway. Such a control member advantageously enables the gas passageway to be opened or closed at discretion; in contrast thereto, the temperature-responsive actuator enables the area of cross-section of the passageway to be controlled, in particular by narrowing or widening it.

In a particularly advantageous embodiment, the control member and the actuator are disposed on opposite sides of the sealing means, so that they extend, for example, in the direction of the longitudinal axis of the appliance, and that control member and actuator act upon the sealing elements, preferably an elastic diaphragm, independently of each other.

A further proposal includes fastening the control member and/or the temperature-responsive actuator directly in the valve housing, preferably by threaded engagement. For one purpose, direct thermal contact of the valve housing with the temperature-responsive actuator is thereby accomplished, and for another purpose, the use of additional components for fastening the control member and/or the actuator is avoided.

Particularly advantageously, the actuator is fastened in the valve housing in the immediate vicinity of the sealing element, a short relative distance of sealing element to actuator thus precluding the possibility of thermal or mechanical interference.

In a still further feature of the present invention, it is proposed manufacturing the sealing element from an elastic material, in particular plastics, a textile or similar non-metal material. This is of particular advantage in the simultaneous use of an On/Off switch as well a temperature-responsive control mechanism with a sealing element.

In a particular embodiment of the present invention, recesses of in particular hemispherical shape are provided in the gas passageway. Recesses of this shape are easy to manufacture and can be provided in a wide variety of locations in the gas passageway, in particular in cases where the passageway is provided at the location of the parting line of the housing halves.

By arranging the actuator on the side of the diaphragm-type sealing element opposite the recess, and by providing the actuator with an equally hemispherical end, the actuator is in a position to urge the sealing element into the recess in the gas passageway in a manner producing particularly low wear.

Advantageously, the contours of the recesses in the gas passageway as well as of the ends of the actuator are of like profile, thus enabling the area of cross-section of the gas passageway to be varied, in particular reduced, by the actuator in a controlled manner. With this arrangement, the area of cross-section of the gas passageway may be reduced from its maximum possible value down to zero, thus effecting control of the gas flow.

In a particularly advantageous embodiment of the present invention which may also be an invention in its own right, the sealing element is configured as a valve plate. Such a dish-shaped valve plate is a part which is easy to manufacture and ideally suited for quantity production. Such a valve plate also affords economy of manufacture, ease of assembly, and reliability in operation of the appliance.

In an advantageous feature of the present invention, the valve plate has a sealing surface of a substantially circular-disk-shaped and plane configuration which cooperates with a diaphragm of an equally plane configuration. A maximum possible sealing surface is thereby obtained between the valve plate and the diaphragm, which differs from many other sealing arrangements known in the art which frequently have only a ring- or line-shaped sealing surface. Further, the flat engagement of the valve plate with the diaphragm also requires a lower contact force than in known sealing means.

Advantageously, the valve plate has on its sealing surface a central recess serving to centrally locate, and provide a defined abutment surface for, the contact tip of the actuator. By arranging for the tip of the actuator to be matingly received with the recess, the two components can be accurately adjusted in the cold condition of the appliance—cold adjustment—, which is also the best prerequisite for a perfect control function in the hot condition of the appliance.

In another feature of the present invention, a spring bears against the valve plate on the valve plate rear side facing away from the sealing surface. This ensures advantageously a reliable contact pressure of the valve plate upon the sealing surface of the diaphragm.

In a particular embodiment, the spring is configured as a compression spring. This is a particularly advantageous, straightforward, reliable, and economical configuration of the spring.

The valve plate itself is advantageously made of a wear-and temperature-resistant material, in particular a sheet of metal or metalloid material; this ensures a defined, stable and wear-resistant form of the valve plate for the full service life of an appliance of the invention.

In a further feature, it is proposed fabricating the diaphragm from a rubber-like material, in particular Viton. This equally affords ease and economy of manufacture of the diaphragm.

Particularly advantageously, only one non-metal sealing element is provided in the gas passageway between the fuel gas reservoir at the one end and the combustion chamber of the appliance at the other end, as described in the preceding paragraph. Wear caused by movement of the one, usually metal sealing element relative to the other, non-metal sealing element, is thereby reduced to a minimum. In addition, an optimum sealing effect is accomplished by the combination of a metal sealing element with a non-metal sealing element.

Advantageously, the diaphragm is provided between a mounting plate and the valve housing of the appliance. This affords ease of assembly and a secure positioning of the diaphragm between the two components.

Slots for guiding the gas are provided on the side of the mounting plate close to the diaphragm. Intermediate the individual gas guiding slots which are customarily arranged parallel to each other, bridge members are provided for flat seating engagement with, and providing a supporting function for, the diaphragm. Advantageously, the diaphragm is fixedly held in place between the mounting plate and the valve housing to the maximum possible extent, without the surface area of the diaphragm experiencing any deflection.

Further objects, features, advantages and application possibilities of the present invention will become apparent from the subsequent description of embodiments illustrated in more detail in the accompanying drawings. It will be understood that any single feature and any combination of single features described and/or represented by illustration form the subject-matter of the present invention, irrespective of their summarization in the claims and their back-references.

BRIEF DESCRIPTION OF THE DRAWINGS

FIG. 2 is a sectional view of a valve assembly showing a detail within dashed lines of FIG. 1 on;

DETAILED DESCRIPTION OF THE INVENTION

Figure 1:
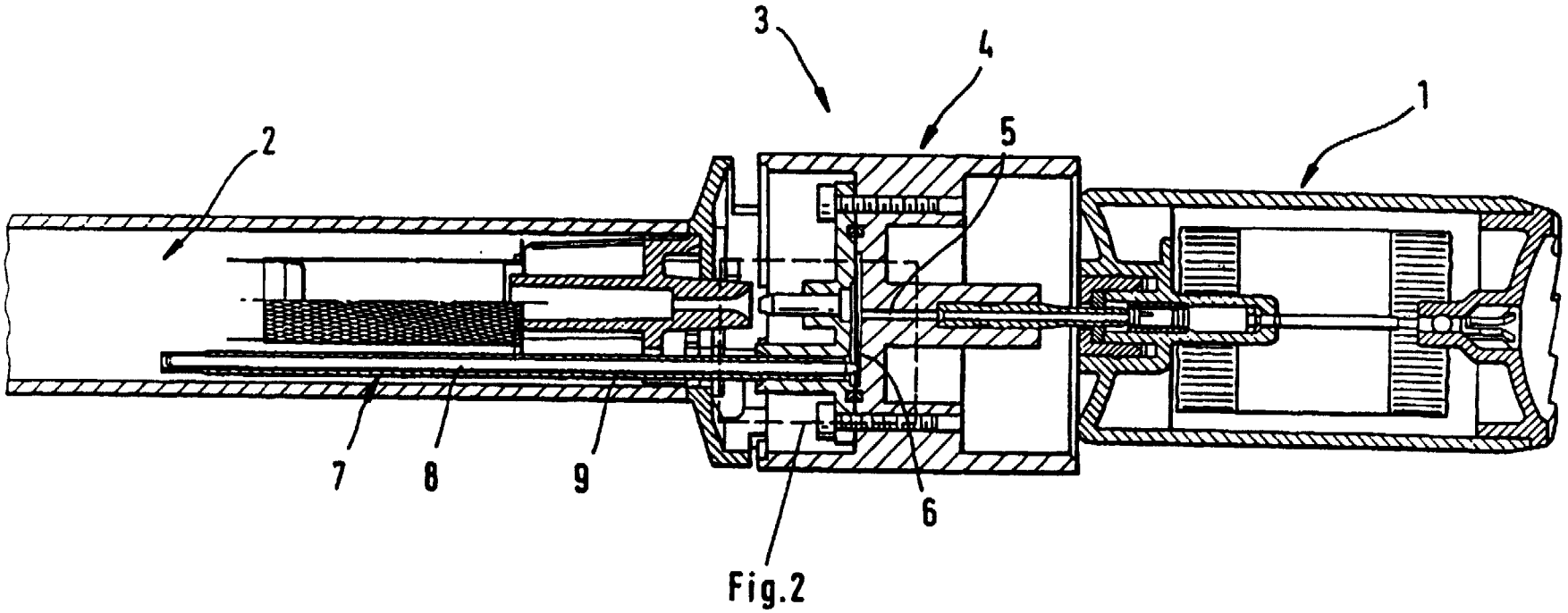
FIG. 1 is a longitudinal sectional view of a gas-heatable curling iron.

A gas-heatable curling iron (FIG. 1) substantially comprises a cartridge-type fuel gas reservoir 1 and a combustion chamber 2, as well as a valve assembly 3 disposed between these two components. The valve assembly comprises a valve housing 4 having a passageway 5 to supply the combustion chamber 2 with fuel gas from the fuel gas reservoir 1. To control and/or regulate the quantity of fuel gas available to the combustion chamber 2, the passageway 5 is associated with a sealing element 6 that varies the area of cross-section of the gas passageway, opening or closing the passage. To actuate the sealing element 6, an actuating actuator 7 is provided which is, for example, made of a bimetal. It is comprised of a rod 8 of a material less sensitive to heat, and of a tube 9 more sensitive to heat and encompassing the rod 8, the tube material varying its length in dependence upon the temperature of the combustion chamber to thus control actuation of the sealing element 6.

Figure 2:
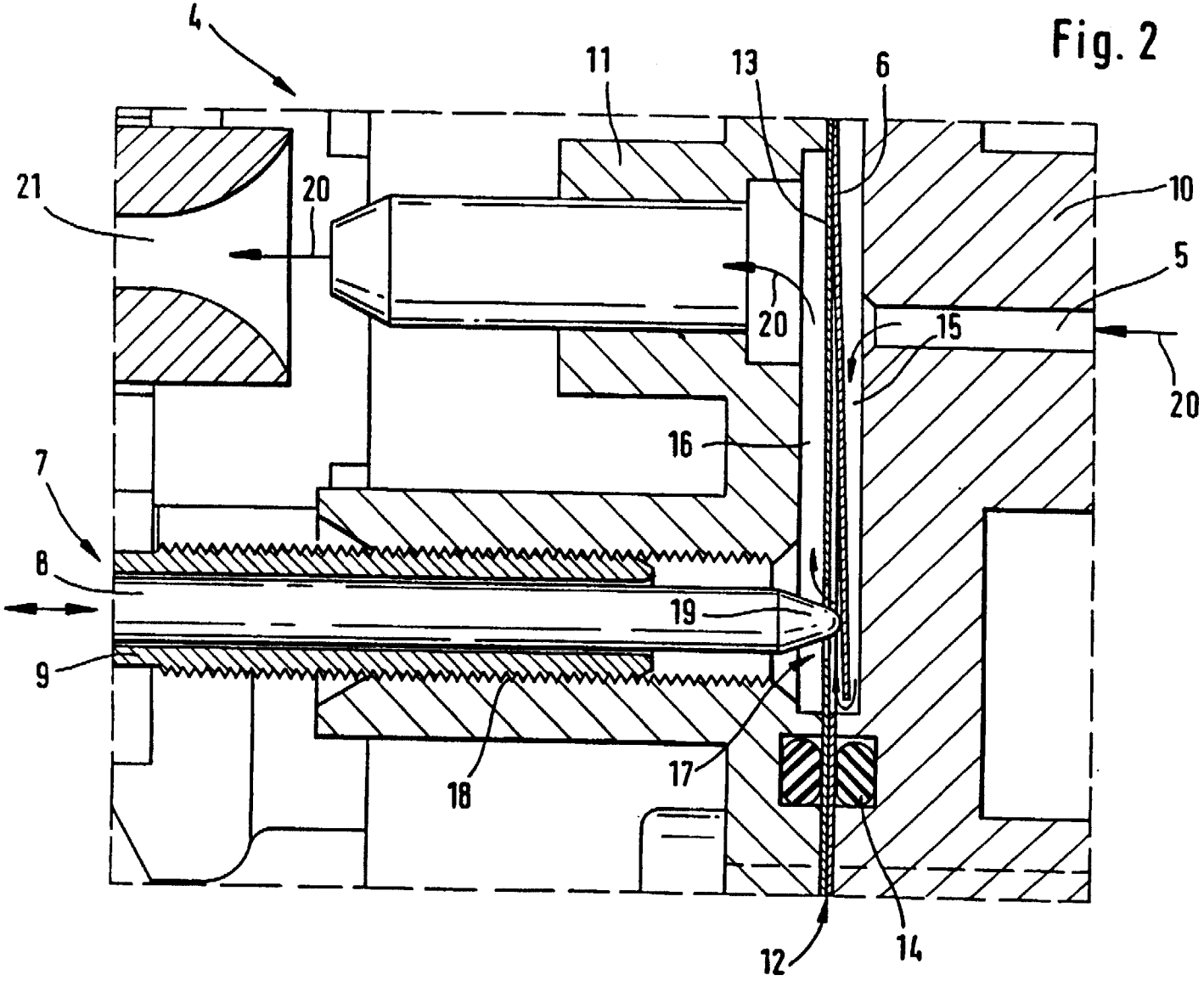

In the center of FIG. 1, an area drawn in broken lines denotes an embodiment of a valve assembly essential to the invention which is illustrated in FIG. 2 on an enlarged scale. The valve housing 4 is comprised of two housing halves 10, 11 substantially symmetrical about the axis and divisible by a nearly plane parting line 12. Placed into the plane of the parting line 12 are the film-type sealing element 6 and the partition wall 13 which are sealed against the housing halves 10, 11 by ring seals 14 disposed outside the gas passageway.

At the facing ends of the housing halves 10, 11, there are provided on either side of the sealing element 6 respective gas passageways 15, 16 separated from each other by the partition wall 13. In the partition wall 13 a gas orifice 17 is provided which is adapted to be closed by the tongue-shaped sealing means 6. In this arrangement, the two elements 6, 13 may be of identical outer contour, for example. However, the sealing element 6 includes a U-shaped slot, enabling the elastic tongue produced by the slot to be moved out of the mounting plane of the sealing means 6. This is effected by the actuator 7 which is arranged in the direction of the longitudinal axis of the curling iron. The outer tube 9 of the actuator 7 is made of a material, such as aluminium, more sensitive to heat than the rod 8 which is, for example, of high-grade steel. At the end remote from the sealing element 6, the rod 8 and the outer tube 9 are connected in a gas-tight relationship to each other. The tube 9 is threaded into a tapped hole 18 in the housing half 11 such that at room temperature the tip 19 of the rod extends into the gas orifice 17, lifting the tongue of the sealing means 6 just clear of the partition wall 13. On an increase in temperature in the combustion chamber during operation, thermal expansion of the tube 9 causes also the tip 19 of the rod 8 to retract from the gas orifice 17, so that the tongue of the sealing element 6, by reason of the material-specific restoring forces as well as by the pressure differential on either side of the sealing element 6, recloses the gas orifice 17.

The direction of gas flow in the gas duct system is identified by arrows. Arriving from the fuel gas reservoir 1, fuel gas 20 enters the gas passageway 5 and is deflected into passageway 15 by the sealing element 6. When the actuator 7 is out of engagement with the sealing element 6, the gas orifice 17 is closed, causing the fuel gas 20 to remain in the two passageways 5, 15.

When, however, the tongue of the sealing element 6 is deflected by the tip 19 of the actuator 7, fuel gas 20 is directed about the tongue of the sealing element 6, entering through the gas orifice 17 the gas passageway 16 of the housing half 11. Here fuel gas 20 experiences a double deflection until it is discharged from the housing half 11 and introduced into the combustion chamber through a venturi nozzle 21.

Figure 3:
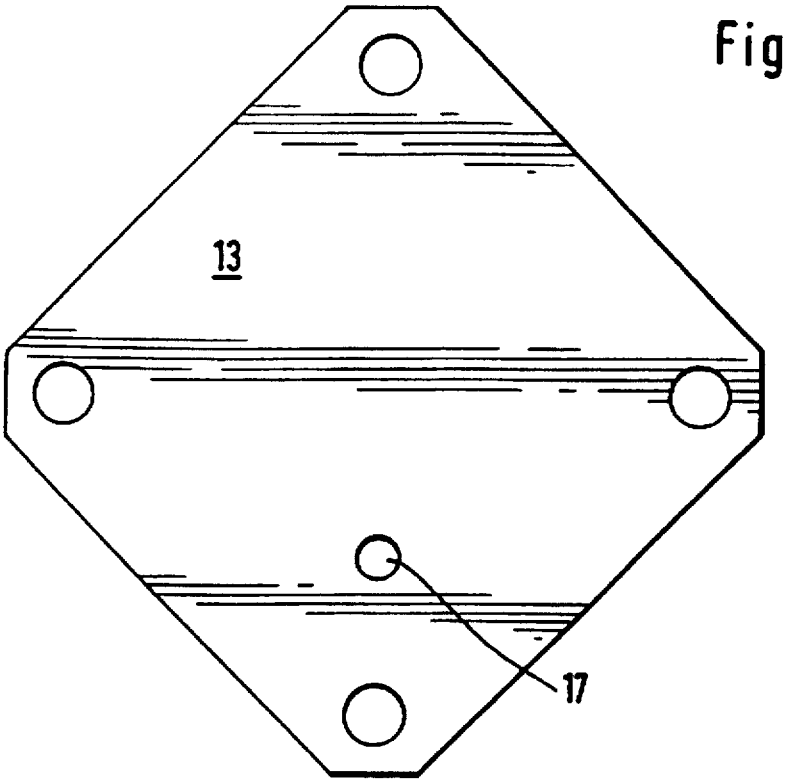
FIGS. 3 and 4 are top plan views of a partition wall with gas orifice and, respectively, a sealing element.
Figure 4:
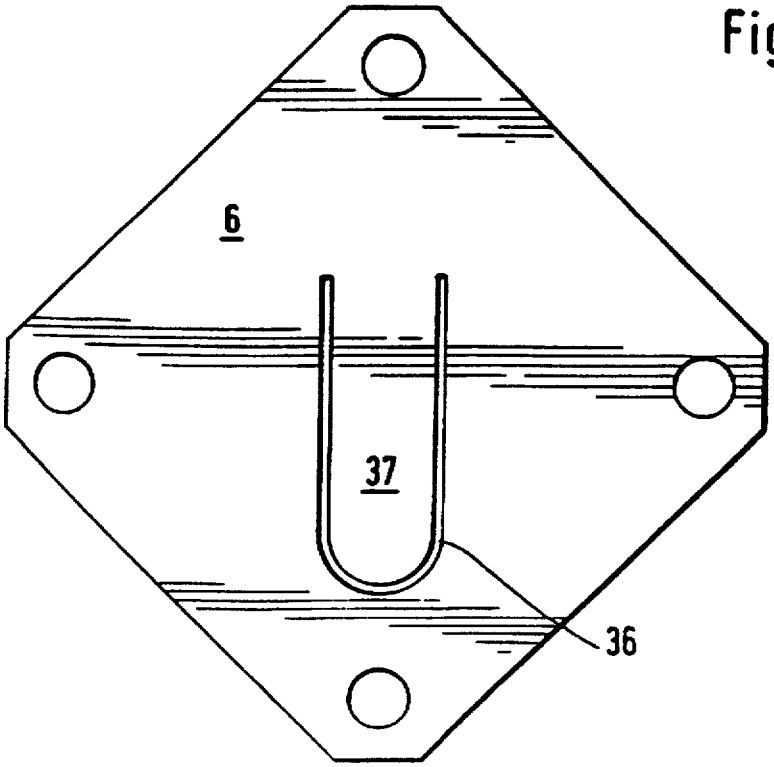

The partition wall 13 and the sealing element 6 of FIG. 2 have two congruent, substantially square contours and are provided with four bores each for the passage of mounting screws therethrough (FIGS. 3, 4). Different from the sealing element 6 of FIG. 4, the partition wall 13 of FIG. 3 includes an additional gas orifice 17. By contrast, however, the sealing element 6 is provided with a U-shaped slot 36 forming an elastic tongue 37. In this arrangement, the position of the tongue 37 is selected such as to sufficiently overlap and close the gas orifice 17 when the two components 6, 13 are mounted in register with one another.

Figure 5:
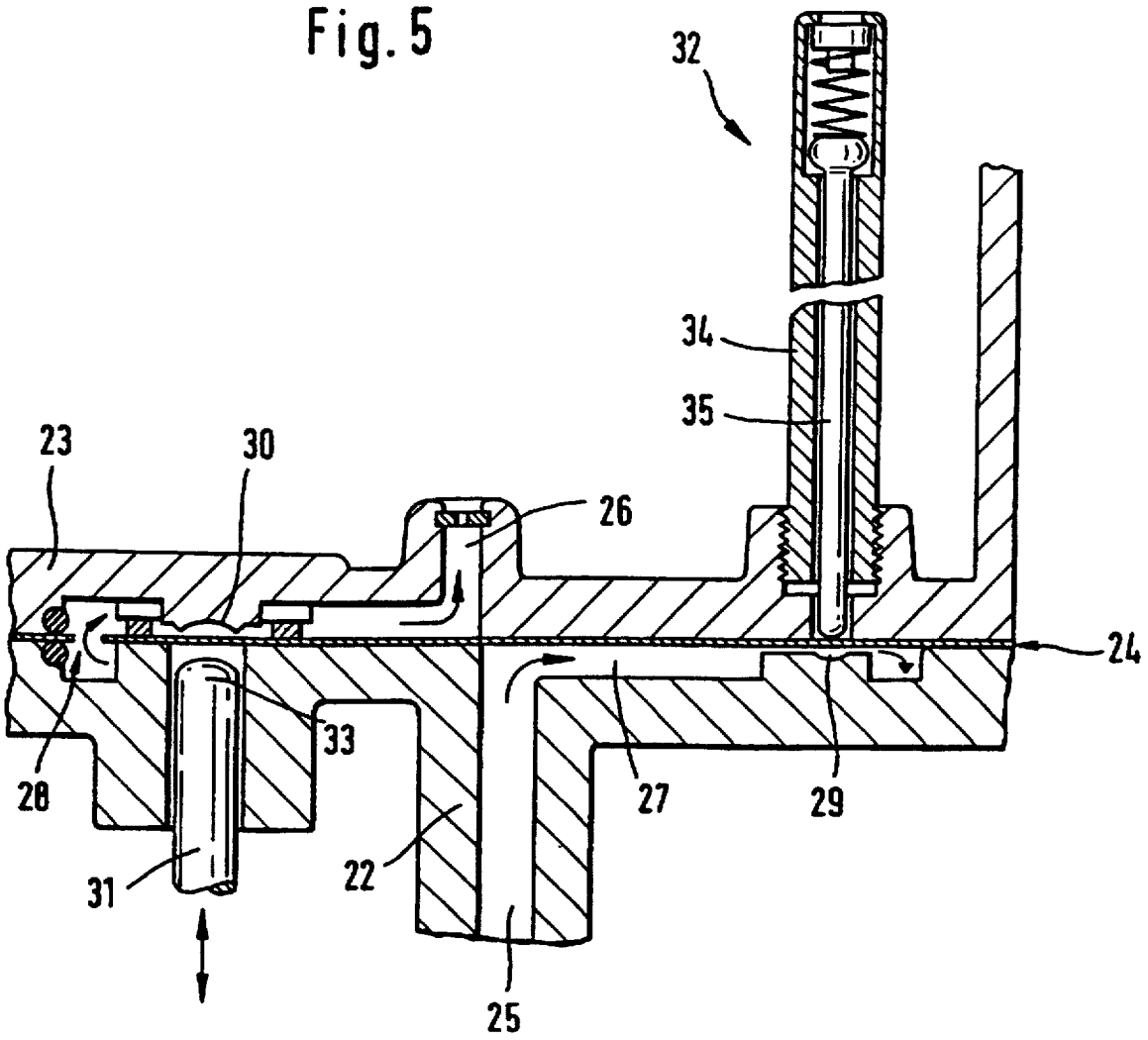
FIG. 5 is a schematic view of a valve assembly illustrating an alternative embodiment thereof.

An alternative embodiment of a valve assembly (FIG. 5) comprises two housing halves 22, 23 and a diaphragm-type sealing element 24 preferably made of a non-metal material and sandwiched between the two housing halves. A gas inlet channel 25 and a gas outlet channel 26 are provided in the housing halves 22 and, respectively, 23. These two channels 25, 26 are connected by a ring channel 27 extending in the housing half 22 on the inlet side and the housing half 23 on the outlet side. Provided in the sealing element 24 is an aperture 28 through which fuel gas travels from the one housing half 22 into the other housing half 23. The ring channel 27 includes two hemispherical recesses 29, 30 provided in the housing halves 22, 23 on opposite sides of the sealing element 24. On the sides of the sealing element 24 facing away from the recesses 29, 30, an actuating means 32 and, respectively, an On/Off switch 31 are provided. The components 31, 32 are both of a rounded configuration at their respective ends so that, for example, by actuating the control member 31, the sealing element 24 is urged into the recess 30 by the end 33 of the control member. This closes the outlet channel, thus preventing fuel gas from being routed to the gas outlet channel 26.

The actuating element 32 is of a construction similar to that of the actuating element 7, comprising an outer tube 34 receiving a rod 35 therein. In this arrangement, however, the rod 35 is made of a material more sensitive to heat than the material of the tube 34. As a result, when the actuating element 32 is heated, the rod 35 expands, urging the sealing means 24 into the recess 29. This varies the area of cross-section of the gas passageway in accordance with the length variation of the rod 35, effecting control of the gas stream.

An alternative embodiment of a device for the temperature-responsive control and/or regulation of a gas-heatable appliance (FIG. 6) includes a fuel gas reservoir 41, a combustion chamber 42, as well as a valve assembly 43 disposed therebetween. The valve assembly 43 is essentially comprised of a valve housing 44 having a gas passageway 45 disposed substantially in the direction of main flow 57. In this arrangement, the direction of main flow 57 is also parallel to the longitudinal axis of the complete appliance. The passageway 45 terminates in another gas passageway 46 disposed normal thereto and provided at the end of the valve housing 44 close to the combustion chamber 42. This passageway 46 is sealed off by a diaphragm 53 made from an elastic material. This diaphragm 53 has an aperture 54 dimensioned such as to enable the contact tip of the actuator 48 to extend therethrough while also allowing the passage of gas between this tip and the edge of the aperture 54. In this arrangement, the actuator 48 is recognized to comprise a rod 49 with a contact tip and a tube 50 encompassing the rod, the tube being made of a material more sensitive to heat than the material of the rod 49.

The diaphragm 53 is held in position by seating a mounting plate 58 on the diaphragm 53 and connecting it to the valve housing 44. The mounting plate includes gas guiding slots 47, so that gas flowing through the aperture 54 in the diaphragm 53 is routed through the slots 47 to the nozzle 55. The nozzle 55 may also be inserted into the mounting plate 58 direct. Gas discharged from the nozzle 55 in the direction of main flow 57 is then conveyed directly into the combustion chamber 42 through a venturi nozzle not shown.

To control and/or regulate the amount of fuel gas necessary for combustion, a valve plate 51 is directly associated with the temperature-responsive actuator 48. This valve plate 51 is received in the valve housing 44 and supported by a compression spring 52 exerting a constant contact pressure on the valve plate in the direction of the diaphragm 53. With the control arrangement in the cold condition, the contact tip of the rod 49 extends through the aperture 54 to the upper side of the valve plate, keeping it spaced from the diaphragm 53 by a distance 56. This distance 56 provides for opening of the gas passageway 46, allowing gas in the passageway 46 to flow through the aperture 54 and the gas guiding slots 47 to the nozzle 55.

Figure 6:
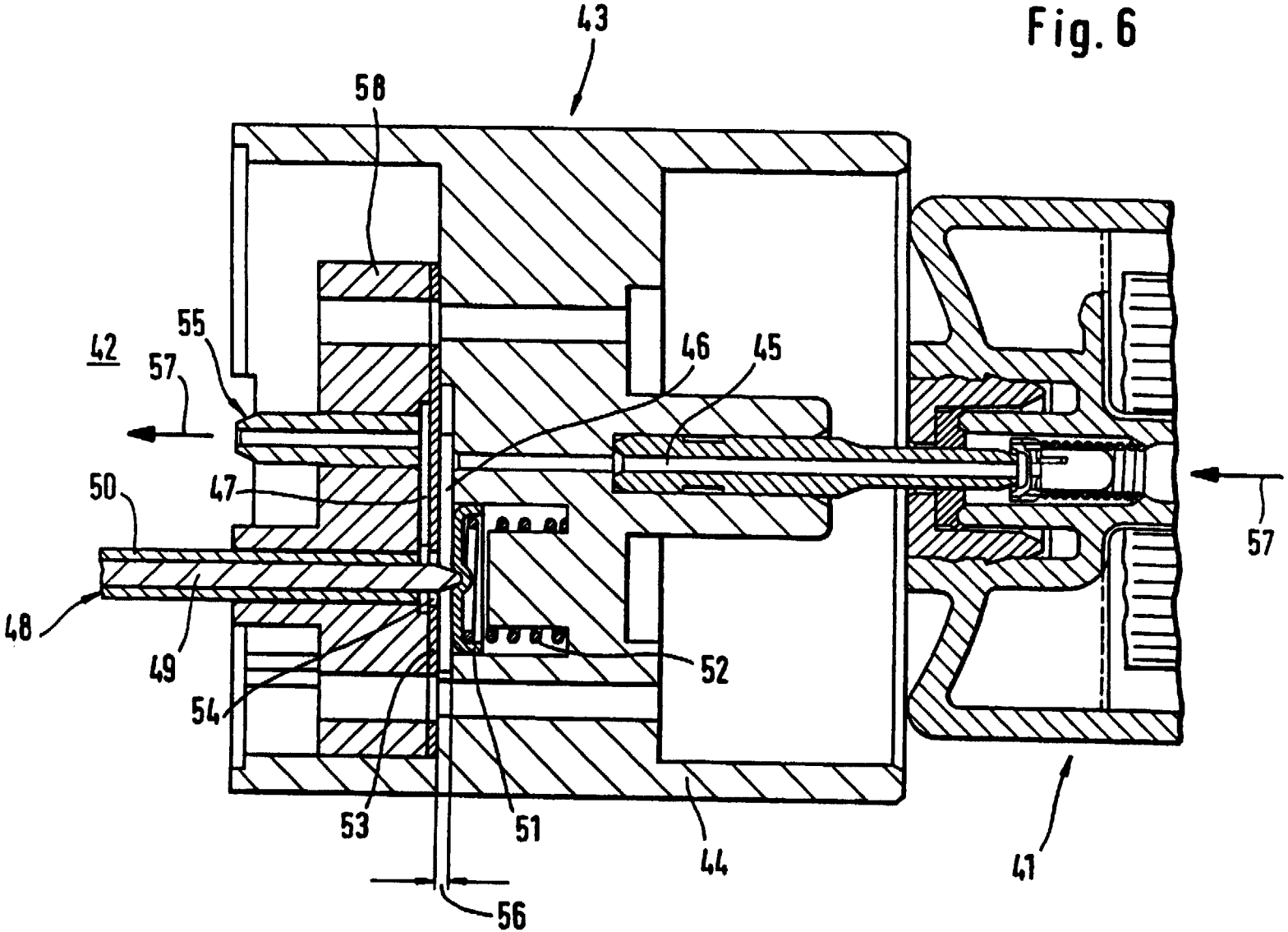
FIG. 6 is a sectional view of a valve assembly with a valve plate in the open position, illustrating an alternative embodiment thereof.
Figure 7:
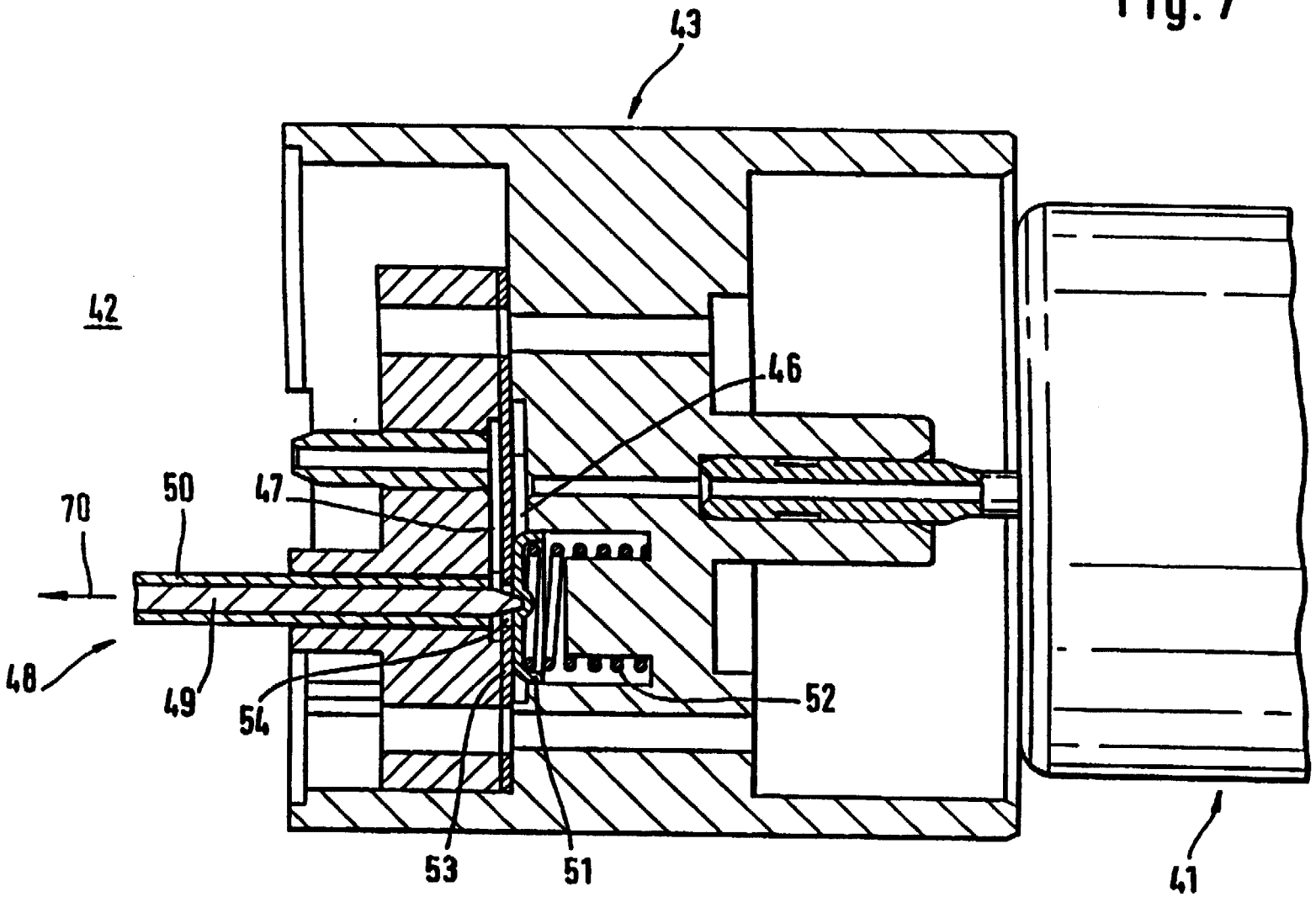
FIG. 7 is a sectional view of the valve assembly of FIG. 6, but showing the valve in the closed position.

FIG. 7 shows the same device as described with reference to FIG. 6, but in a hot operating condition. In this control condition, thermal expansion of the tube 50 has caused displacement of the control rod 49 in the direction 70. As a result, the valve plate 51 can be urged into engagement with the sealing surface of the diaphragm 53 by the compression spring 52. The aperture 54 in the diaphragm 53 is closed, thus sealing the gas passageway 46 against the gas guiding slots 47. Flow of gas is thus interrupted.

Figure 8:
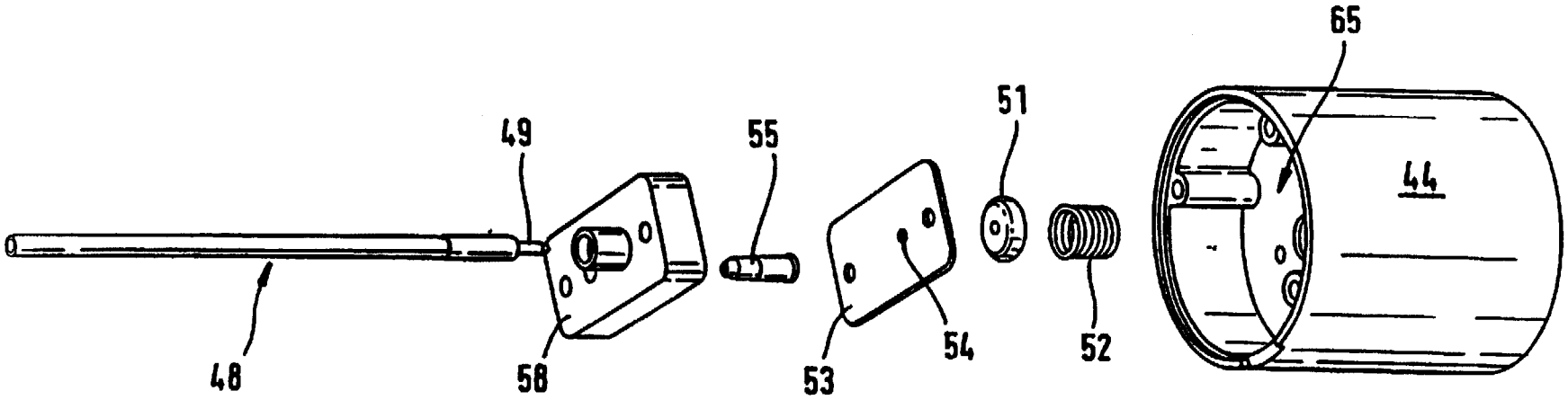
FIG. 8 is an exploded view of the essential components of the valve assembly of FIG. 6.

The valve assembly of FIG. 8 includes a cup-shaped, substantially cylindrical socket 65 at its end close to the combustion chamber 42. This socket 65 receives therein the further components of the control arrangement. These include, in the sequence illustrated, the compression spring 52, the valve plate 51, the diaphragm 53 with the aperture 54 for the passage of gas, as well as the nozzle 55 which is directly connected to the mounting plate 58. The mounting plate 58 holds the diaphragm 53 in a fixed position within the socket 65 of the valve housing 44. The end of the actuator 48 close to the valve housing 44 is mounted in the mounting plate 58.

Figure 9:
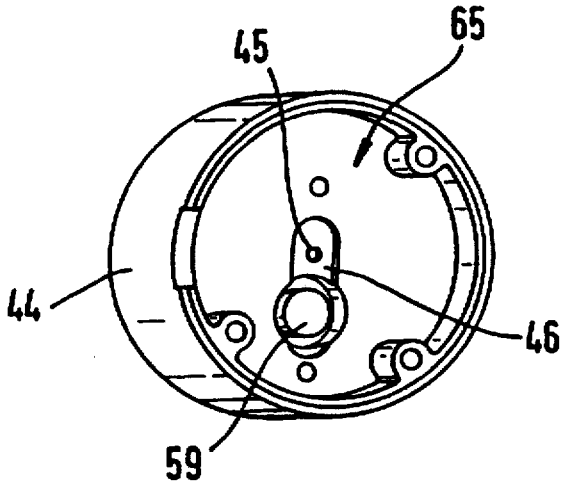

Disposed in the socket 65 of the valve housing 44 (FIG. 9) at the bottom thereof is the outlet of the gas passageway 45 terminating into the gas passageway 46, with passageway 46 establishing communication between the passageway 45 and the recess 59. The valve plate and the compression spring are inserted into this recess 59 and sealed off by the diaphragm.

Figure 10:
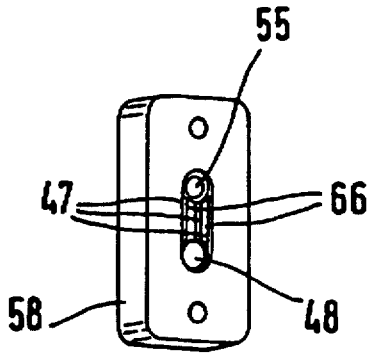
FIGS. 9 and 10 are perspective views of a valve housing and, respectively, a mounting plate of the valve assembly of FIG. 6.

The mounting plate 58 of FIG. 10 is inserted into the socket 65 such that the opening for passage of the actuator 48 is disposed on the recess 59, while the bore for the nozzle 55 is disposed on the opening of the gas passageway 45. To establish communication between the two openings for the actuating means 48 and the nozzle 55, three parallel gas guiding slots 47 are provided. This enables the diaphragm which is placed onto the upper face of the mounting plate 58 to be supported by the bridge members 66 disposed between the gas guiding slots 47. This advantageously avoids deflection of the diaphragm in the direction of the mounting plate 58.

Figure 11:
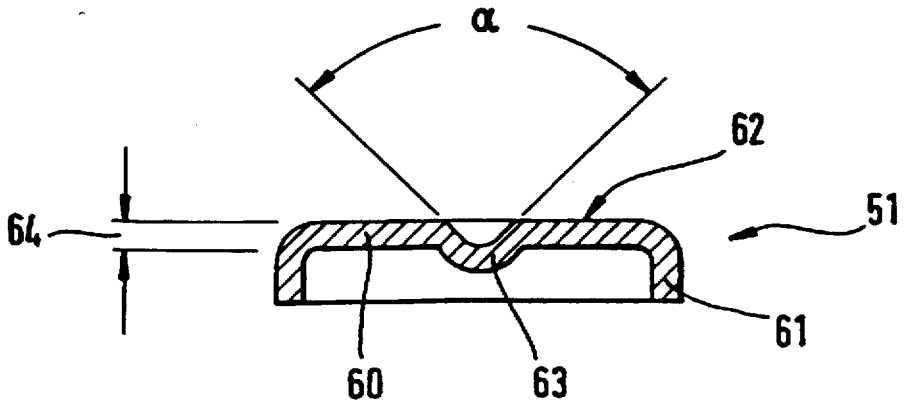
FIG. 11 is a sectional view of a valve plate.

The valve plate 51 of FIG. 11 is comprised of a disk 60 with a circumferential flange 61. A central recess 63 is provided in the disk 60; this recess has a depth 64 and a gradient of slope $\alpha$ mating with the geometry of the contact tip of the control rod such as to ensure at all times contact between the actuator and the valve plate 51 which is as close to a point contact as possible. In this arrangement, the end of the control rod is preferably provided with a hemispherical tip, and the recess in the valve plate has an at least partially plane area cooperating with the contact tip referred to in the foregoing. On the upper face of the valve plate 51, the sealing surface 62 is a nearly circular-disk-shaped surface, with the exception of the recess 63.

We claim:

1. A gas-heatable appliance for personal use adapted to receive a fuel gas reservoir and comprising means forming a combustion chamber and a valve assembly disposed between the fuel gas reservoir and the combustion chamber for regulating a flow of fuel gas supplied in response to the temperature of the combustion chamber, wherein the valve assembly comprises a valve housing defining a gas passageway, a sealing element arranged in the passageway and selectively at least partially occluding the passageway and displaceable during combustion between a first position permitting a first flow of gas and a second position permitting a second flow of gas different from said first gas flow, and a temperature-responsive actuator, disposed in the valve housing and in thermal communication with the combustion chamber, directly contacting the sealing element, whereby the actuator is displaceable in response to the temperature of the combustion chamber to move the sealing element during combustion to meter the gas flow.

2. The appliance as claimed in claim 1, wherein the sealing element comprises a flexible diaphragm.

3. The appliance as claimed in claim 2, wherein the diaphragm comprises a metal film.

4. The appliance as claimed in claim 1 wherein the valve assembly further comprises a partition wall having an orifice communicating with the gas passageway and in register with the sealing element.

5. The appliance as claimed in claim 4 wherein the sealing element comprises a flexible tongue in register with the partition wall orifice.

6. The appliance as claimed in claim 4 wherein the sealing element is hinged to the partition wall.

7. The appliance as claimed in claim 1 wherein the sealing element is formed of a resilient material biasing the sealing element towards occluding the passageway.

8. The appliance as claimed in claim 1 wherein the valve assembly further comprises a spring urging the sealing element towards occluding the gas passageway.

9. The appliance as claimed in claim 4 wherein the actuator extends through the partition wall orifice towards the sealing element.

10. The appliance as claimed in claim 4 wherein the partition wall orifice receives fuel gas at an upstream side thereof from the gas reservoir and discharges the gas at a downstream side thereof towards the combustion chamber, and the actuator is arranged substantially on the downstream side of the orifice and the sealing element is arranged on the upstream side of the orifice.

11. The appliance as claimed in claim 1 wherein the sealing element consists of metal.

12. The appliance as claimed in claim 4 wherein the valve assembly further comprises a sealing surface formed of a plastic material disposed between the sealing element and the partition wall.

13. The appliance as claimed in claim 1 wherein the valve housing comprises at least a first upstream housing portion and a second downstream housing portion.

14. The appliance as claimed in claim 13 wherein the sealing element is disposed at an interface between the two housing portions.

15. The appliance as claimed in claim 14 wherein the gas passageway is formed at least partially in each housing portion and extends on either side of the sealing element, whereby the sealing element divides the gas passageway into an upstream portion and a downstream portion.

16. The appliance as claimed in claim 1 wherein the sealing means deflects the flow of fuel gas.

17. The appliance as claimed in claim 1 wherein the valve assembly further comprises a control member actuatable by the user to open or close the gas passageway.

18. The appliance claimed in claim 17 wherein the control member and the actuator are disposed on opposite sides of the sealing element.

19. The appliance is claimed in claim 1 wherein the actuator is secured directly to the valve housing.

20. The appliance as claimed in claim 1 wherein the actuator is secured to the valve housing adjacent the sealing element.

21. The appliance as claimed in claim 1 wherein the sealing element is formed of a flexible material selected from the group of materials consisting of plastic and textile.

22. The appliance as claimed in claim 1 wherein the gas passageway further defines a recess within which at least a portion of the sealing element is displaced by the actuator.

23. The appliance as claimed in claim 17 wherein the gas passageway further defines first and second recesses facing respectively the actuator and the control member and being disposed opposite the sealing element, whereby at least a first portion of the sealing element is displaced within the first recess by the actuator and a second portion of the sealing element within the second recess by the control member.

24. A gas-heatable appliance for personal use adapted to receive a fuel gas reservoir and comprising means forming a combustion chamber and a valve assembly disposed between the fuel gas reservoir and the combustion chamber for regulating a flow of fuel gas supplied in response to the temperature of the combustion chamber, wherein the valve assembly comprises a valve housing defining a gas passageway, a sealing element arranged in the passageway and selectively at least partially occluding the passageway, and a temperature-responsive actuator, disposed in the valve housing and in thermal communication with the combustion chamber, directly contacting the sealing element, whereby the actuator is displaceable in response to the temperature of the combustion chamber to move the sealing element to meter the gas flow, wherein an area of cross section permitting the flow of gas in the passageway varies in response to the actuator moving the sealing element.

25. The appliance as claimed in claim 1 wherein the sealing element comprises a valve plate.

26. A gas-heatable appliance for personal use adapted to receive a fuel gas reservoir and comprising means forming a combustion chamber and a valve assembly disposed between the fuel gas reservoir and the combustion chamber for regulating a flow of fuel gas supplied in response to the temperature of the combustion chamber, wherein the valve assembly comprises a valve housing defining a gas passageway, a sealing element arranged in the passageway and selectively at least partially occluding the passageway, wherein the sealing element comprises a valve plate, a temperature-responsive actuator, disposed in the valve housing and in thermal communication with the combustion chamber, directly contacting the sealing element, whereby the actuator is displaceable in response to the temperature of the combustion chamber to move the sealing element to meter the gas flow, and a diaphragm having an orifice communicating with the gas passageway and in register with the valve plate, and the valve plate comprises a disk-shaped sealing surface having a greater radial extent than the orifice, whereby the sealing surface surrounds the orifice when the valve plate contacts the diaphragm.

27. A gas-heatable appliance for personal use adapted to receive a fuel gas reservoir and comprising means forming a combustion chamber and a valve assembly disposed between the fuel gas reservoir and the combustion chamber for regulating a flow of fuel gas supplied in response to the temperature of the combustion chamber, wherein the valve assembly comprises a valve housing defining a gas passageway, a sealing element arranged in the passageway and selectively at least partially occluding the passageway, wherein the sealing element comprises a valve plate, and a temperature-responsive actuator, disposed in the valve housing and in thermal communication with the combustion chamber, directly contacting the sealing element, whereby the actuator is displaceable in response to the temperature of the combustion chamber to move the sealing element to meter the gas flow, wherein the valve plate comprises a recess on a surface facing the actuator for receiving at least a tip portion of the actuator.

28. The appliance as claimed in claim 25 wherein the sealing element further comprises a spring urging the valve plate to occlude the gas passageway.

29. A gas-heatable appliance for personal use adapted to receive a fuel gas reservoir and comprising means forming a combustion chamber and a valve assembly disposed between the fuel gas reservoir and the combustion chamber for regulating a flow of fuel gas supplied in response to the temperature of the combustion chamber, wherein the valve assembly comprises a valve housing defining a gas passageway, a sealing element arranged in the passageway and selectively at least partially occluding the passageway, wherein the sealing element comprises a valve plate and a spring urging the valve plate to occlude the gas passageway, and a temperature-responsive actuator, disposed in the valve housing and in thermal communication with the combustion chamber, directly contacting the sealing element, whereby the actuator is displaceable in response to the temperature of the combustion chamber to move the sealing element to meter the gas flow, wherein the spring is a compression spring.

30. The appliance as claimed in claim 25 wherein the valve plate comprises a wear- and temperature-resistant metallic material.

31. The appliance as claimed in claim 26 wherein the diaphragm comprises a rubber-like material.

32. The appliance as claimed in claim 31 wherein the diaphragm comprises Viton.

33. The appliance as claimed in claim 26 wherein the diaphragm consists of a non-metallic material.

34. The appliance as claimed in claim 26 wherein the valve assembly further comprises a mounting plate received in the valve assembly and supporting the diaphragm.

35. The appliance as claimed in claim 34 wherein the mounting plate defines a plurality of slots forming a portion of the gas passageway for receiving gas from the diaphragm orifice.

36. The appliance as claimed in claim 1 wherein the valve assembly further comprises a moveable control member contacting the sealing member and manually operable by a user, the control member displacing the sealing element to occlude the gas passageway.

37. The appliance as claimed in claim 4 wherein the sealing element is formed of a resilient material biasing the sealing element towards occluding the partition wall orifice.

38. The appliance as claimed in claim 1 wherein the second flow of gas is less than the first flow of gas, whereby the actuator displaces the sealing element from the first position to the second position in response to an increased temperature.

39. The appliance as claimed in claim 38 wherein the actuator applies a greater load to the sealing element in the first position than in the second position.

40. The appliance as claimed in claim 38 wherein the actuator applies a greater load to the sealing element in the second position than in the first position.

41. A gas-heatable appliance for personal use adapted to receive a fuel gas reservoir and comprising a combustion chamber and a valve assembly disposed between the fuel gas reservoir and the combustion chamber for regulating a flow of fuel gas supplied in response to the temperature of the combustion chamber, wherein the valve assembly comprises a valve housing defining a gas passageway, the passageway having at least a first portion and a second portion and a channel connecting the first and second portions, a sealing membrane arranged in the passageway and at least partially displaceable within the channel between a first position permitting the flow of fuel gas and a second position permitting a lesser flow of fuel gas, and a temperature-responsive actuator, disposed in the valve housing and in thermal communication with the combustion chamber, directly contacting the sealing membrane, whereby the actuator is displaced in response to an increased temperature of the combustion chamber to move the sealing membrane from the first position to the second position to meter the gas flow.

42. A gas-heatable appliance for personal use adapted to receive a fuel gas reservoir and comprising a combustion chamber and a valve assembly disposed between the fuel gas reservoir and the combustion chamber for regulating a flow of fuel gas supplied in response to the temperature of the combustion chamber, wherein the valve assembly comprises a valve housing defining a gas passageway, a diaphragm having an orifice communicating with the passageway, a sealing element arranged in the passageway in register with the orifice and at least partially displaceable relative to the orifice between a first position permitting the flow of fuel gas and a second position permitting a lesser flow of fuel gas, and a temperature-responsive actuator, disposed in the valve housing and in thermal communication with the combustion chamber, directly contacting the sealing element, whereby the actuator is displaced in response to an increased temperature of the combustion chamber to move the sealing element from the first position to the second position to meter the gas flow.

43. The appliance as claimed in claim 42 wherein the sealing element comprises a valve plate biased towards the second position.

44. The appliance as claimed in claim 42 wherein a portion of the actuator extends through the diaphragm orifice to contact the sealing element.

45. A gas-heatable appliance for personal use adapted to receive a fuel gas reservoir and comprising means forming a combustion chamber and a valve assembly disposed between the fuel gas reservoir and the combustion chamber for regulating a flow of fuel gas supplied in response to the temperature of the combustion chamber, wherein the valve assembly comprises a valve housing defining a gas passageway, a sealing element arranged in the passageway and selectively at least partially occluding the passageway, and a temperature-responsive actuator, disposed in the valve housing and in thermal communication with the combustion chamber, directly contacting the sealing element, whereby the actuator is displaceable in response to the temperature of the combustion chamber to move the sealing element to meter the gas flow, wherein the actuator comprises a rod member and a jacket member about the rod member, the jacket and rod members being formed of materials having dissimilar coefficients of thermal expansion.

46. The appliance as claimed in claim 45 wherein the jacket and rod members comprise a bimetal.

* * * * *